US008758465B2

(12) United States Patent
Schultink et al.

(10) Patent No.: US 8,758,465 B2
(45) **Date of Patent: *Jun. 24, 2014**

(54) BLOCK-BASE BAG FOR VACUUM CLEANERS

(75) Inventors: Jan Schultink, Overpelt (BE); Ralf Sauer, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 118 days.

This patent is subject to a terminal disclaimer.

(21) Appl. No.: 13/377,067

(22) PCT Filed: Jun. 16, 2010

(86) PCT No.: PCT/EP2010/003594

§ 371 (c)(1),
(2), (4) Date: Mar. 14, 2012

(87) PCT Pub. No.: WO2010/149297

PCT Pub. Date: Dec. 29, 2010

(65) Prior Publication Data

US 2012/0186204 A1 Jul. 26, 2012

(30) Foreign Application Priority Data

Jun. 24, 2009 (EP) ..... 09008280

(51) Int. Cl.
*B01D 46/02* (2006.01)

(52) U.S. Cl.
USPC ..... 55/309; 55/367; 55/368; 55/372; 55/374; 55/382; 55/486; 55/DIG. 2; 55/DIG. 5; 15/347; 15/352; 15/353; 96/222; 96/223; 96/226; 96/227

(58) Field of Classification Search
USPC ..... 55/309, 367, 368, 372, 374, 382, 486, 55/DIG. 2, DIG. 5; 15/347, 352, 353; 96/222, 223, 226, 227
See application file for complete search history.

(56) References Cited

U.S. PATENT DOCUMENTS

| | | | | |
|---|---|---|---|---|
| 2,848,062 | A | 8/1958 | Meyerhoefer | |
| 5,603,741 | A | 2/1997 | Frey | |
| 6,063,171 | A | 5/2000 | Moyher, Jr. et al. | |
| 8,066,803 | B2 * | 11/2011 | Sauer et al. | 96/223 |
| 8,092,562 | B2 * | 1/2012 | Sauer et al. | 55/367 |
| 8,236,078 | B2 * | 8/2012 | Rosemeier et al. | 55/382 |
| 8,372,174 | B2 * | 2/2013 | Schultink et al. | 55/365 |
| 8,449,639 | B2 * | 5/2013 | Sauer et al. | 55/367 |
| 2007/0084166 | A1 | 4/2007 | Wattenberg et al. | |
| 2007/0175190 | A1 | 8/2007 | Schultink | |
| 2008/0314005 | A1 | 12/2008 | Sauer et al. | |
| 2009/0031683 | A1 | 2/2009 | Schultink et al. | |
| 2009/0301043 | A1 | 12/2009 | Rosemeier et al. | |

FOREIGN PATENT DOCUMENTS

| | | |
|---|---|---|
| DE | 78 04 400 | 9/1980 |
| DE | 92 09 964.5 | 12/1992 |
| DE | 103 48 375 | 5/2005 |
| DE | 20 2005 016 309 | 1/2006 |
| DE | 20 2006 016 303 | 1/2007 |

(Continued)

*Primary Examiner* — Frank Lawrence, Jr.
*Assistant Examiner* — Minh-Chau Pham
(74) *Attorney, Agent, or Firm* — Fay Kaplun & Marcin, LLP

(57) ABSTRACT

A block-base bag is for vacuum cleaners. The bag includes, in the interior thereof, a diffuser made of strips of material and/or sheet materials with oblong-shaped flow openings. Such bags are distinguished by excellent dust storage capacity and extension of the useful life.

30 Claims, 9 Drawing Sheets

(56) References Cited

FOREIGN PATENT DOCUMENTS

| | | |
|---|---|---|
| DE | 20 2006 016 304 | 1/2007 |
| DE | 20 2006 019 108 | 3/2007 |
| DE | 20 2007 000 198 | 4/2007 |
| DE | 20 2007 010 692 | 11/2007 |
| DE | 10 2006 051 117 | 1/2008 |
| DE | 20 2008 003 248 | 6/2008 |
| DE | 20 2008 007 717 | 9/2008 |
| DE | 20 2008 008 9 | 10/2008 |
| EP | 0 960 645 | 12/1999 |
| EP | 1 776 909 | 4/2007 |
| EP | 1 787 560 | 5/2007 |
| EP | 1 795 247 | 6/2007 |
| EP | 1 804 635 | 7/2007 |

* cited by examiner

BLOCK-BASE BAG FOR VACUUM CLEANERS

FIELD OF INVENTION

The present invention relates to a block-base bag for vacuum cleaners, which has, in the interior thereof, at least one diffuser made of strips of material and/or sheet materials with oblong-shaped flow openings. Such bags are distinguished by excellent dust storage capacity and extension of the useful life.

BACKGROUND INFORMATION

The increase in dust storage capacity—i.e. extension of the useful life (lifespan)—of a vacuum cleaner filter bag is, in addition to improved separation power (particle retention), a substantial aim in the development of filter bags.

This can be achieved by innovative bag materials or also by the incorporation of material surfaces which influence the airflow in the filter bag. Thus EP 0 960 645 and EP 1 795 247 disclose nonwoven materials for vacuum cleaner bags having particularly good dust storage capacity.

EP 1 787 560 shows flow distributors in the form of squares or strips of material which are fitted in the region of the inlet opening of the filter bag and are able to split and deflect the incoming airflow into partial flows. In EP 1 804 635, the concept is developed with respect to a second flow distributor supplementing the function of the first flow distributor. From DE 20 2008 008 989 and DE 20 2008 003 248, combinations of two flow distributors with a spacing means are known.

From DE 20 2006 016 303, a filter bag which comprises a bag having an interior which is subdivided into at least two chambers is known. In the case of one embodiment, the subdivision is effected by a separating wall which is fixed at three side edges, a transition between the first and the second chamber being formed at the fourth side edge. In another embodiment, the separating wall is welded to the filter layers only at one side edge for the entire length and is welded on the opposite side to a strip on the upper layer made of filter material.

DE 20 2008 007 717 describes a filter bag in which a planar, multilayer filter insert which is connected at least partially to the filter bag walls is disposed in the interior. Dust is intended thereby to be incorporated between the at least two layers of the filter insert. For this purpose, the upper of the two layers can be perforated or slotted. The filter insert can be configured as a continuous strip which is fixed at two oppositely situated edges of the bag.

DE 20 2007 010 692 relates to a filter bag in which a filler layer made of fibre- or yarn material extends between the two filter walls, which layer is connected to both filter walls and, when the bag is unfolded, is pulled apart such that a net-like structure is produced in the bag.

A dust filter bag having a blocking wall part fitted in the interior is known from DE 20 2006 019 108. This blocking wall part is mounted in front of the inlet opening of the bag such that it bulges out during operation and forms two outlet openings through which the airflow is deflected. It is essential to the invention that the blocking wall part is mounted at a spacing relative to the bag seam and does not abut against the rear bag wall under the pressure of the airflow.

A further air distributor is known from DE 10 2006 051 117. At least two material layers are thereby disposed one above the other between the bag walls, the layers having less extension in a first surface direction than the two bag walls and, in the surface direction orthogonal to the first surface direction, having the same extension as the bag walls. There may be mentioned as materials, microfibre nonwoven or paper.

DE 20 2006 016 304 discloses a bag having at least one guide element, by means of which the incoming airflow can be deflected. The guide element is fixed adjacent to the inflow opening.

A bag already found on the market of the company Miele has an arrangement of a deflection device which is fitted directly below the inlet opening. This deflection device consists of a sheet material which is fitted directly with the upper side of the bag on both sides of the inlet opening. The purpose of this deflection device resides in deflecting the airflow which is suctioned in through the inlet opening directly in the region of the inlet opening. This deflection device is configured such that it is welded directly to the bag wall at a spacing relative to the inlet opening on the basis of a prescribed length or area. The area of this deflection device is therefore below approx. 10% of the bag surface. However, it is problematic with these bags that, because of the relatively small dimensioning of the first deflection device (SR1), the result can be blockages of the bag due to dust accumulating between the inflow opening and the deflection device so that the bag becomes unusable. In addition, this vacuum cleaner bag also has a second plane of flow directors.

The production of block-base bags made of nonwoven is described in DE 20 2005 016 309 and also EP 1 776 909, in which a vacuum cleaner bag having a base from which circumferential side walls extend in one direction for the formation of an interior space is described, the base having an essentially rectangular base portion.

The basic shape of a block-base bag is described in DE 20 2007 000 198 U1. There is consequently understood by a block-base bag, a filter bag which has a bag body made of a one- or multilayer filter material, has a surface which forms two oppositely situated sides, the bag upper side, which contains an inlet opening or on which the block-base which contains an inlet opening is folded back, and the bag underside and also two side walls folded in on the bag undersides between the surface walls.

Reference is likewise made to DE 78 04 400, DE 76 30 890 and also DE 92 09 964, which deal with the basic construction of a block-base bag, for definition of the shape of a block-base bag.

A further block-base bag having a closed free end region and an oppositely situated, at least partially closed, region and also a retaining plate is known from DE 103 48 375, the base of the bag being formed from a plurality of layers of the bag material which are situated one above the other.

Block-base bags made of paper with rigid inserts in the interior are known from U.S. Pat. No. 5,603,741. U.S. Pat. No. 2,848,062 discloses a block-base bag having an inserted, partially planar, unslotted material layer.

It is however common to all the previously mentioned vacuum cleaner bags that the inflowing dirt particles are only distributed inadequately so that the result is premature blockage of the vacuum cleaner bag, which ultimately leads to reduced dust storage capacity and a significantly inadequate lifespan of the vacuum cleaner bag.

SUMMARY OF INVENTION

The present invention relates to a block-base filter bag which ensures increased dust storage capacity and hence an extension of the useful life (lifespan). In addition, blockage of the opening in the interior of the bag is intended to be prevented.

According to the invention, a block-base bag having a bag front side, a bag rear-side and also a block-base at a spacing from the bag front-side and the bag rear-side in order to form a bag interior, with bag walls made of an air-permeable filter material, is hence provided, the bag front-side or the block-base having an inlet opening for the air to be filtered and at least one diffuser being disposed in the interior of the block-base bag, which diffuser consists of at least two individual strips of material and/or sheet materials, disposed next to each other, which have oblong-shaped flow openings, the at least one diffuser being connected to the bag wall on at least one side.

There is thereby understood according to the invention by a block-base bag, a filter bag which has a front-side, a rear-side and also at least three surfaces for producing an inner volume. With respect to the geometric configurations and the folding principles of the block-base bag, reference can be made in this respect to the bag forms which are known from the state of the art and discussed further back. Hence, one of the at least three side surfaces thereby forms the base side of the filter bag, whilst the two remaining side surfaces respectively connect the outer edges which delimit the front-side and also the rear-side to each other, as a result of which an interior which defines the volume of the filter bag in the operating state is formed. Preferably, at least the two side surfaces which are disposed between the front- and the rear-side have a fold which allows the filter bag to collapse such that a planar contact is made possible between the front- and the rear-side of the filter bag. Either the base surface or the front-side of the filter bag thereby has an air inlet opening. Such a filter bag unfolds due to the inflowing air in the operating state itself, such filter bags are therefore termed SOS (self-opening sack). In the sense of the invention, butt-ended bags are also termed block-base bags.

The diffusers fitted in the interior of the bag according to the invention, which are formed from strips of material or sheet materials provided with flow openings, thereby cause turbulence of the inflowing air which is laden with dirt- and/or dust particles. Hence the lifespan of the bag can surprisingly be substantially extended.

The diffuser made of a floppy material is thereby formed either from at least two strips of material, disposed next to each other, but can also consist of sheet materials which have flow openings in the sense of slots within these sheet materials. Such sheet materials hence have at least one slot or a cut which however is not impressed continuously over the entire sheet material so that, at the ends of the sheet material, i.e. wherever there is no slotting, cohesion of the sheet material is ensured. The geometric shape of the strips of material or the geometric shapes formed by the flow openings on the sheet material is thereby essentially irrelevant; thus the strips of material can for example be structured as strips or the sheet materials by straight slots, however likewise all other possible geometric shapes of strips of material or sheet materials are possible, for example also s-shaped strips or slot guides, but also through-openings etc.

It was found surprisingly that the filter bags have an excellent dust storage capacity and hence an increased lifespan. It can likewise be observed that blockages in the region of the air inlet of the bag—as can frequently be the case in the bags known from the state of the art—could be avoided.

In an advantageous embodiment according to the invention, the strips of material are disposed moveably relative to each other; it is likewise possible that the strips of material are at a spacing relative to each other or that the flow openings of the sheet materials are dimensioned such that the resulting strips of material are at a spacing relative to each other.

It is further preferred that the width of the strips of material is 2 mm to at most 50% of the width of the bag upper side. Particularly preferred widths of the strips of material are thereby of orders of magnitude between 5 and 35% of the width of the bag. The same applies for the arrangement of the oblong flow openings relative to each other in the sheet materials, the flow openings defining the width of the strip.

It is further advantageous if the oblong-shaped flow openings of the sheet materials are linear. However, almost any geometric shapes are possible for the oblong flow openings, thus the flow openings can for example have a parallel or meandering or zigzag configuration, furthermore helical lines are likewise conceivable.

In a further advantageous embodiment, the linear, oblong flow openings have a different length within the sheet material. This embodiment of the invention is useful when at least two flow openings are present on the sheet material. These flow openings can thereby have a different length, which leads to improved stability of the diffuser.

It is likewise preferred that the at least one diffuser is mounted on the bag wall on both sides. In this embodiment, the diffuser is hence fixed respectively on the bag upper side or bag underside. Fixing is thereby effected preferably respectively in the end region of the diffuser so that this is connected merely at points to the bag wall and is flexible in the region situated therebetween because of the floppy material and can be moved by the inflowing air.

It is likewise advantageous if the diffuser has approximately the same length and/or width as the bag upper- or underside. Fixing of the diffuser in this case can be effected then expediently by introducing the ends of the diffuser between the upper- and underside of the filter bag and fixing them together with the upper- and underside to form the finished bag. Fixing of the diffuser is thereby effected therefore at the same time as the gluing or welding step for the production of the filter bag itself. In this respect, this possibility for the fixing enables an extremely economical and simple production of the filter bag.

As an alternative embodiment hereto, it is however likewise possible that the diffuser is narrower and/or shorter than the bag upper- or underside. It is further possible here that the diffuser has a greater length and/or width than the bag upper- or underside and is present folded. Folding of the diffuser is effected expediently when the length of the diffuser is greater than the dimensioning of the length and/or width of the filter bag. Folding is then effected expediently in zigzag form, for example partial overlapping of the strips of the diffuser one above the other being effected with a diffuser in strip shape. In this respect, an increase in the engagement surface for the inflowing air is made possible, which leads to a further improvement in the properties of the filter bag.

A further embodiment of the present invention provides that the diffuser in the form of strips of material is configured turned and/or twisted. Here also, an increase in the engagement surface for the inflowing air is effected, the same advantages resulting as were described already in the folded shape of the diffuser.

It is likewise preferred that the diffuser in the form of strips of material is formed by filament bundles or bundles of foil strips. In this embodiment, the strips of material themselves are formed from a large number of filaments or threads or the like.

Likewise, at least two diffusers respectively in the intermediate plane can be disposed respectively relative to each other such that the strips of material and/or the oblong flow openings are not disposed parallel to each other, e.g. orthogonally, but also in arrangements deviating herefrom. With such an embodiment, the airflows entering into the filter bag can be made to swirl specifically.

The floppy materials of the diffusers thereby consist preferably of air-permeable materials and/or of air-impermeable materials. There are considered thereby as air-impermeable materials, in particular foils, for example plastic material foils (e.g. PE or PP). There are used as air-permeable materials, preferably laminates of air-permeable materials and/or air-impermeable materials provided with flow openings.

In the case of the composite materials, a construction of a layer of polypropylene spun nonwoven of approx. 15 g/m$^2$, a layer of crimped polypropylene staple fibres of approx. 100 g/m$^2$ and a second finishing spun nonwoven layer of again 15 g/m$^2$ is particularly preferred. The cohesion of the composite is effected via weld points which connect all the layers together.

Furthermore, it is preferred if the diffuser is connected to the bag wall via an adhesive point and/or weld points.

In a further preferred embodiment, the block-base bag in the operating state has a prismatic geometry, the block-base forming the base of this prism. The block-base preferably has a rectangular shape.

It is likewise advantageous if the block-base is disposed angled relative to the bag front-side and relative to the bag rear-side, the angle being from 10° to 170°, preferably from 45° to 125°.

Preferably, the block-base bag is constructed such that an independent deployment, i.e. a quasi complete unfolding of the block-base bag to the operating geometry, is possible independently by air flowing in through the inlet opening.

It is likewise advantageous if the block-base bag in the transporting state is folded such that the block-base is disposed in a planar manner relative to the front- or rear-side of the bag body. For this purpose, the block-base is folded either onto the front- or rear-side, according to whether the block-base is folded onto the front- or rear-side, that side likewise has a fold.

Preferably, the block-base bag has at least two foldable side surfaces.

It is likewise preferred if the diffuser is connected to at least one foldable side surface of the block-base bag, in particular in the region of the fold.

Further advantages result if the inside of the filter bag upper side has a foil (e.g. a PE foil) in the region of the air inlet opening. This foil can be glued on or welded for example. As a result, dust accumulations in the region of the inlet opening can be almost completely avoided during operation so that the closing function of the flap closing the inlet opening is not impaired. Surprisingly, it was however found that the function of this "antifilter cake foil" is improved further by the diffusers according to the invention.

The invention is explained in more detail with reference to the subsequent Figures without restricting the invention to the parameters represented in the Figures.

DETAILED DESCRIPTION

Figure 1:
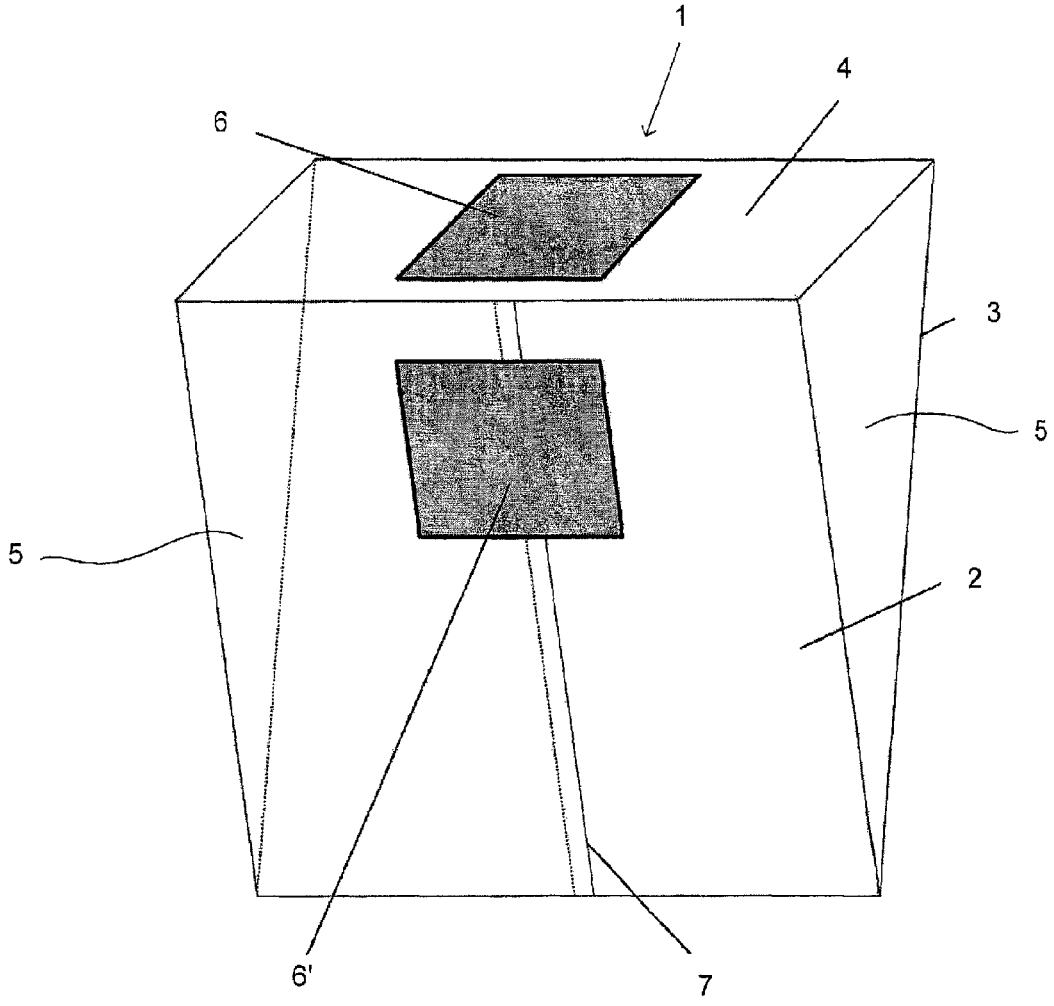
FIG. 1 shows a prismatic block-base bag with a block base according to the present invention.

FIG. 1 shows a filter bag 1 of a prismatic configuration, the largest surfaces of which represent the front-side 2 and the rear-side 3. The block-base 4 represents the base of this filter bag and can likewise be formed from the bag material of the walls of the bag, e.g. a nonwoven material. The block-base 4 can thereby be unreinforced but can also be for example reinforced by a retaining plate 6 which is disposed thereon and connected to the block-base 4, for example by welding or gluing. The retaining plate 6 thereby serves for example for fixing the block-base bag 1 in the vacuum cleaner; the retaining plate 6 has the air inlet opening (not illustrated). In an alternative embodiment, the retaining plate 6' can however likewise be fitted on the front-side 2 of the block-base bag 1. The block-base bag 1 is delimited laterally by the side walls 5. These side walls can have longitudinal folds, as is described for example in DE 103 48 375 or in EP 1 776 909. For the sake of clarity, the side folds are not illustrated. The block-base bag 1 is thereby formed preferably from a single web of the material forming the block-base bag, which material, after corresponding folding on the front-side 2, is placed partially above the longitudinal seam 7 and is connected to the bag 1 by gluing or welding together.

Figure 2:
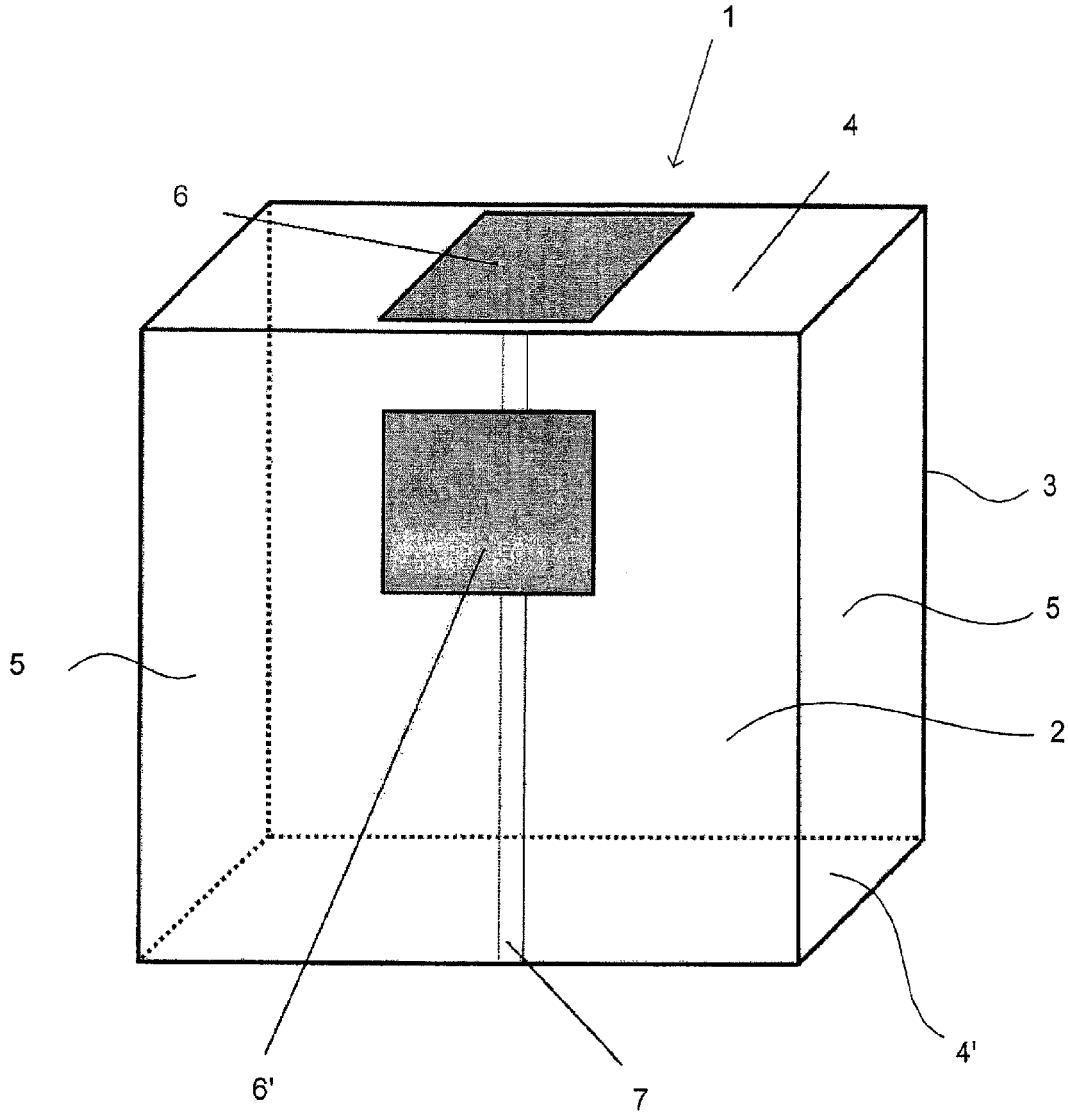
FIG. 2 shows a cuboid double block-base bag according to the present invention.

In FIG. 2, a block-base bag which has, in addition to the block-base 4, a further block-base 4', is illustrated, the block-base 4' forming the underside of the filter bag. Furthermore, the embodiments for FIG. 1 apply in particular with respect to the side folding of the side walls 5.

Figure 3:
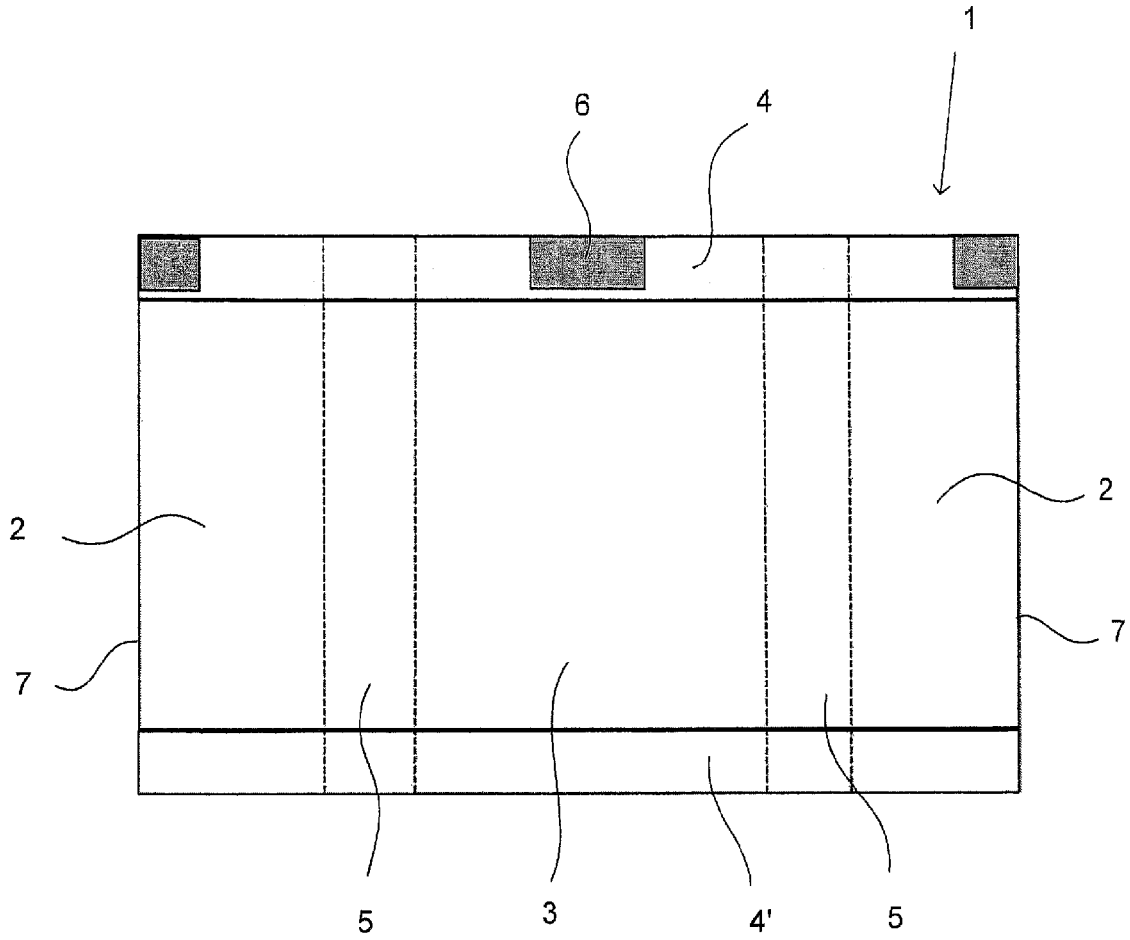
FIG. 3 shows the development of a double block-base bag according to the present invention.

FIG. 3 shows the basic development of the double block-base bag illustrated in FIG. 2. By corresponding folding and connecting of such a web of the filter material, for example the double block-base bag 1 illustrated in FIG. 2 can be produced. With respect to the reference numbers, the embodiments made in FIG. 1 apply, the outer delimitations of the material web of the block-base bag 1, which outer delimitations are described with 7, represent the points at which the material web is shown, for example by welding to the finished block-base bag 1, forming the longitudinal seam 7.

Figure 4:
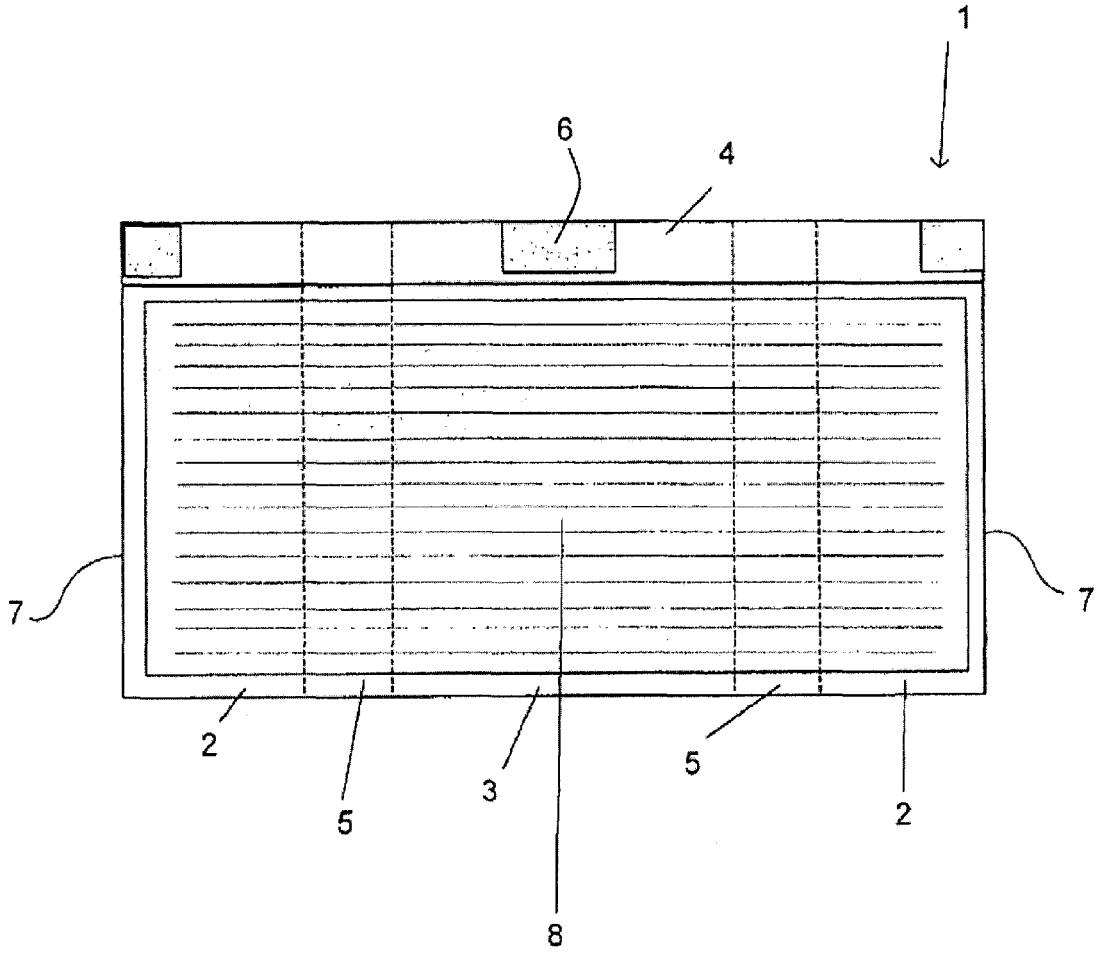
FIG. 4 shows the development of a prismatic block-base bag with slotted diffusers according to the present invention.

In FIG. 4, a corresponding development of a prismatic block-base bag 1 according to FIG. 1 is represented, a view on the side of the material web forming the inside of the block-base bag 1 being represented in FIG. 4. Both the insides of the side surfaces 2, of the side walls 5 and of the rear-side 3 are thereby provided continuously with a diffuser 8 which represents a sheet material which has a large number of parallel extending slots and which can be formed for example from a nonwoven material. The slots of the diffuser which represent the flow openings are thereby not configured universally over the entire surface of the sheet material so that cohesion of the strips of material separated by the slots is provided at the edges of the diffuser 8. The diffuser 8 can thereby be connected at the edges to for example the front-side 2 by welding or gluing so that the diffuser is connected to the wall of the block-base bag 1 on both sides.

Figure 5:
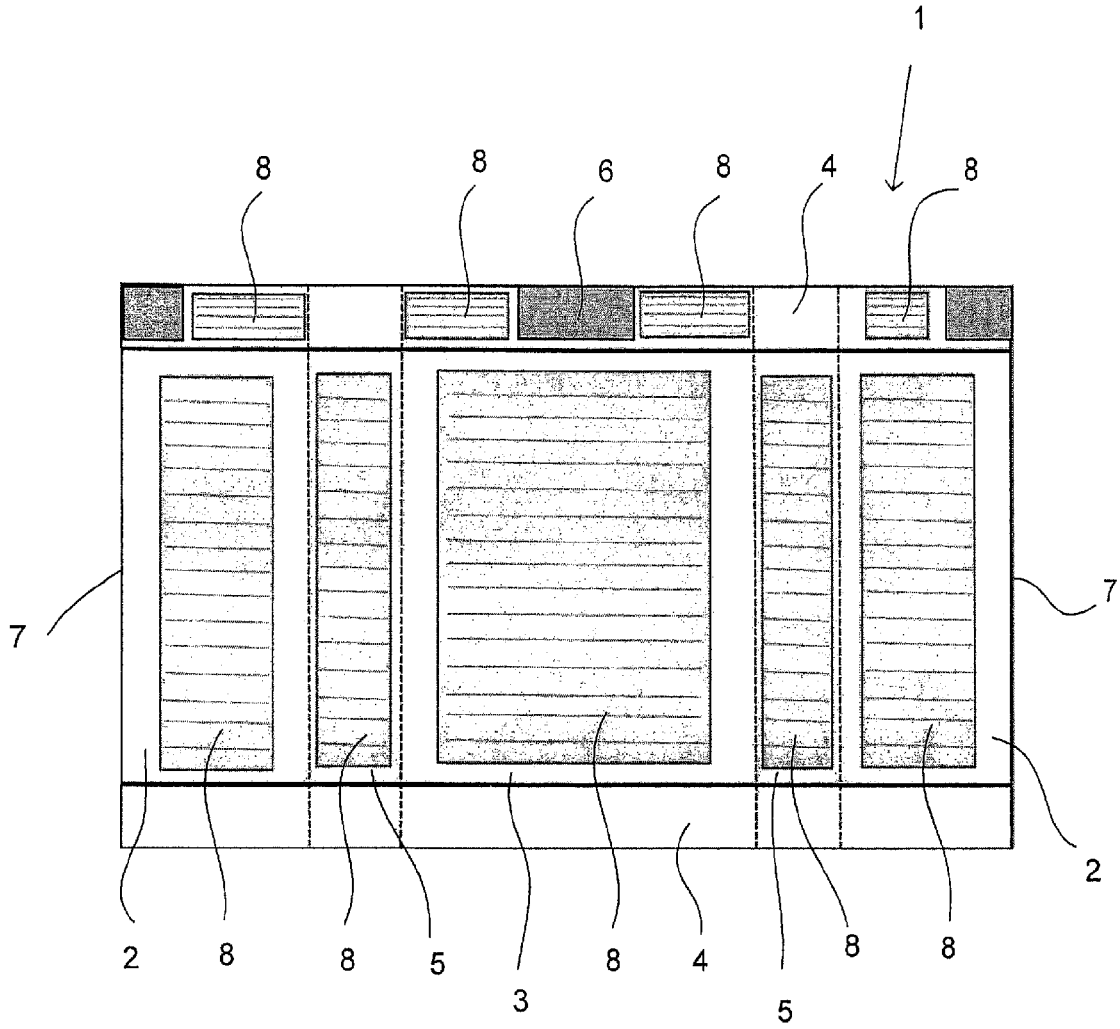
FIG. 5 shows the development of a double block-base bag with various diffusers according to the present invention.

In FIG. 5, an alternative embodiment of a double block-base bag is represented, the wall of the material web forming the inside being represented here also, which web can be formed by corresponding folding together to form the finished block bag 1. The development of the block bag 1 represented in FIG. 5 thereby has a large number of diffusers which are connected respectively to the corresponding walls of the filter bag, for example the front-side 2, the rear-side 3 or the side walls 5. Likewise, diffusers can be disposed in the region of the block-base 4. The represented diffusers 8 are thereby connected preferably to the respective wall of the block-base bag 1 on both sides, for example by welding the materials together.

For further clarification of the invention, tests with prismatic block-base bags were implemented, a filter bag without diffusers being compared with filter bags which have one or two diffusers disposed in the interior. The filter bags used in the examples are represented in the subsequently illustrated FIGS. 6 to 9 for illustration of the arrangement of the diffusers in the interior. All the diffusers are formed from strips of a three-layered nonwoven material. A three-layered composite made of a layer of polypropylene spun nonwoven of approx. 15 g/m$^2$, a layer of crimped polypropylene staple fibres of approx. 100 g/m$^2$ and a second finishing spun nonwoven layer of again 15 g/m$^2$ is particularly preferred. The cohesion of the composite is effected via welding points which connect all the layers together. In the following descriptions of the Figures, an arrangement of the diffusers "longitudinally" means a vertical arrangement of the diffusers illustrated in the Figures, while "transversely" means a horizontal arrangement of the diffusers within the filter bag.

Figure 6:
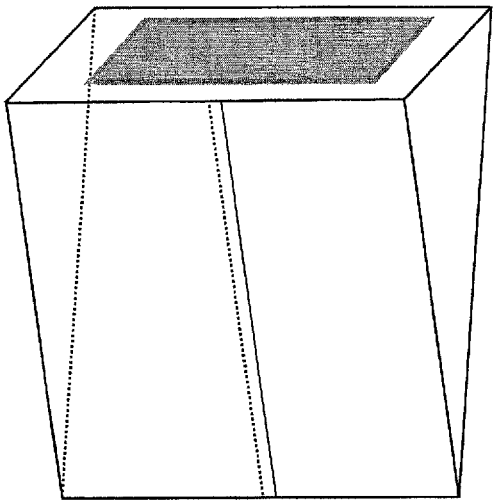
FIG. 6 shows a filter bag without diffusers in the interior (comparative example 1*) according to the present invention.

The Figures show in detail:

FIG. 6 shows a filter bag without diffusers in the interior (comparative example 1*).

Figure 7:
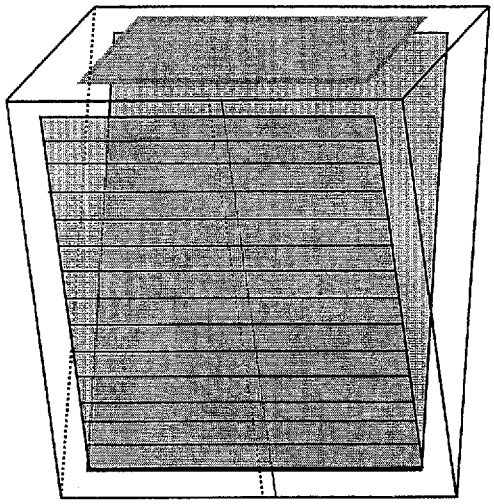
FIG. 7 shows a filter bag according to the present invention with diffusers (21×11 mm) disposed transversely both on the front- and rear-side (example 2)

FIG. 7 shows a filter bag according to the invention with diffusers (21×11 mm) disposed transversely both on the front- and rear-side (example 2).

Figure 8:
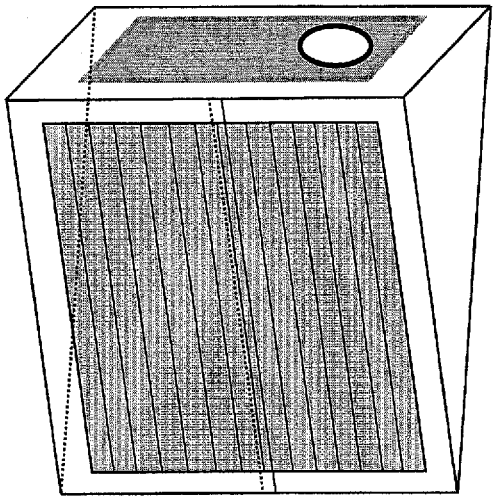
FIG. 8 shows a filter bag according to the present invention with a diffuser (21×11 mm) disposed longitudinally on only one of the front- and rear-side (example 3)

FIG. 8 shows a filter bag according to the invention with a diffuser (21×11 mm) disposed longitudinally on only one of the front- and rear-side (example 3).

Figure 9:
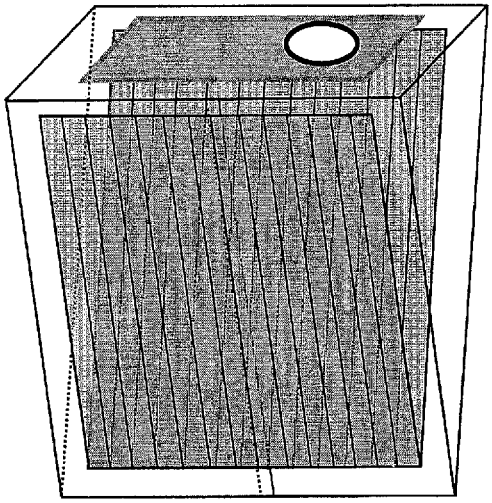
FIG. 9 shows a filter bag according to the present invention with diffusers (21×11 mm) disposed transversely both on the front- and the rear-side (example 4)

FIG. 9 shows a filter bag according to the invention with diffusers (21×11 mm) disposed transversely both on the front- and the rear-side (example 4).

The filter bags represented in FIGS. 6 to 9 are not to scale. The front- and rear-side of the bag are approx. 18 cm wide and 27 cm long. The diffusers had 2 cm spacing at each side, therefore were 14 cm wide and 23 cm long. 21 strips were therefore present with 11 mm width.

The filter bags represented in FIGS. 6 to 9 (of the constructional type FP 136 by the company Vorwerk) were measured in a test series (implemented with a vacuum cleaner by Vorwerk, type VK136) with defined quantities of DMT-standard dust type 8 (50-400 g, respectively in 50 g interval steps). Reference is made in this respect to DIN EN-ISO 60312. The measurement values are indicated for the filter bags in Table 1. The two lower lines of the table respectively show the measured pressure loss in % after picking up 200 or 400 g DMT-standard dust, this value being determined by the measured pressure value after picking up the respective quantity of dust, relative to the measured pressure in the case of the dust filter bag inserted in the vacuum cleaner without having previously picked up dust. Compared with comparative example 1* (dust filter bag without flow directors or diffusers, see FIG. 6), a significant improvement in pressure decrease or pressure loss can be observed with all picked-up quantities of dust. In this respect, the dust filter bags according to the invention have a significantly increased lifespan or dust pick-up capacity relative to the filter bags according to comparative example 1*.

Figure 10:
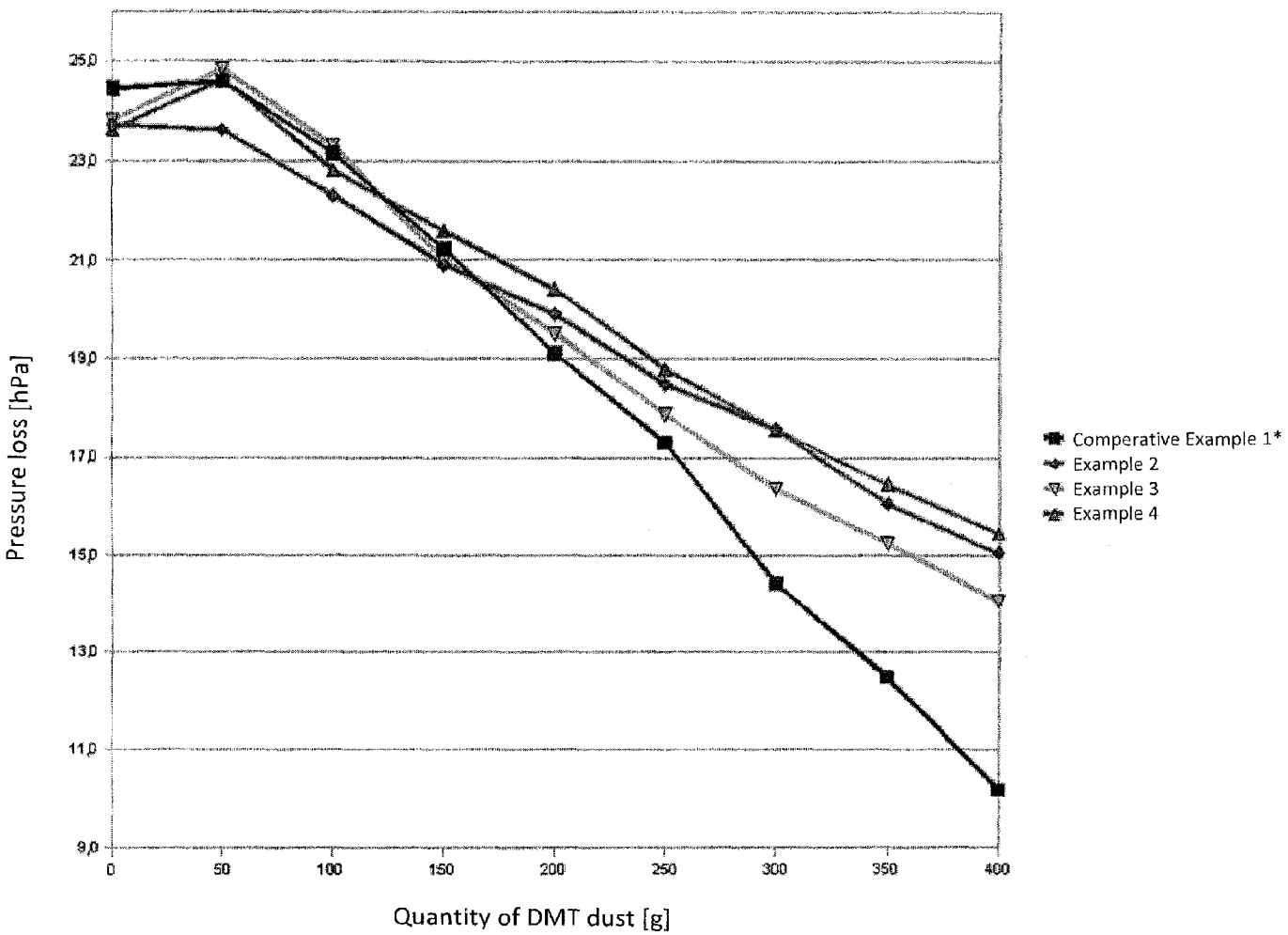
FIG. 10 shows test results with the filter bags according to the present invention which are compared with filter bags according to comparative example 1*.

In FIG. 10, the obtained test results with the filter bags according to the invention are compared with the filter bags according to comparative example 1*. In the diagram, a comparison of the obtained measurement values with those of comparative example 1* takes place respectively. It can be detected clearly that the filter bags according to the invention are clearly superior to the filter bags according to comparative example 1* with respect to the pressure decrease in the case of a previously defined picked-up quantity of dust.

TABLE 1

| | Example No. | | | |
|---|---|---|---|---|
| | 1* | 2 | 3 | 4 |
| | quantity of dust [g] | | | |
| | Pressure [hPa] | Pressure [hPa] | Pressure [hPa] | Pressure [hPa] |
| 0 | 24.4 | 23.7 | 23.8 | 23.6 |
| 50 | 24.6 | 23.6 | 24.8 | 24.6 |
| 100 | 23.2 | 22.3 | 23.3 | 22.8 |
| 150 | 21.2 | 20.9 | 21.0 | 21.6 |
| 200 | 19.1 | 19.9 | 19.5 | 20.4 |
| 250 | 17.3 | 18.5 | 17.9 | 18.8 |
| 300 | 14.4 | 17.6 | 16.4 | 17.6 |
| 350 | 12.5 | 16.1 | 15.2 | 16.5 |
| 400 | 10.2 | 15.0 | 14.0 | 15.5 |
| pressure loss | | | | |
| after 200 g | 22% | 16% | 18% | 14% |
| after 400 g | 58% | 37% | 41% | 35% |

The invention claimed is:

1. A block-base bag, comprising:

a bag front-side, a bag rear-side and a block-base at a spacing from the bag front-side and the bag rear-side, the block-base forming a bag interior with bag walls made of an air-permeable filter material, one of the bag front-side and the block-base having an inlet opening through which the air to be filtered enters, wherein at least one diffuser is disposed in the interior of the block-base bag, which diffuser consists of at least two individual strips of material disposed next to each other, which have oblong-shaped flow openings, and wherein the at least one diffuser is connected to the bag walls on at least one side.

2. The block-base bag according to claim 1, wherein the strips of material are disposed moveably relative to each other.

3. The block-base bag according to claim 1, wherein the strips of material are at a spacing relative to each other.

4. The block-base bag according to claim 1, wherein the width of the strips of material is at least 2 mm and at most 50% of the width of the bag front-side.

5. The block-base bag according to claim 1, wherein the oblong-shaped flow openings of the sheet materials are linear.

6. The block-base bag according to claim 5, wherein the linear flow openings have at least one of a parallel configuration, a meandering configuration and a zigzag configuration.

7. The block-base bag according to claim 5, wherein the linear, oblong flow openings have a different length.

8. The block-base bag according to claim 1, wherein the diffuser is mounted on the bag wall on both sides.

9. The block-base bag according to claim 1, wherein the diffuser has at least one of essentially the same length and essentially the same width as at least one of the bag front-side and the bag rear-side.

10. The block-base bag according to claim 1, wherein the diffuser is at least one of narrower and shorter than at least one of the bag front-side and the bag rear-side.

11. The block-base bag according to claim 1, wherein the diffuser has at least one of a greater length and a greater width than at least one of the bag front-side and the bag rear-side and is present folded.

12. The block-base bag according to claim 1, wherein the diffuser is configured in the form of at least one of turned strips of material and twisted strips of material.

13. The block-base bag according to claim 1, wherein diffuser in the form of strips of material is formed by one of filament bundles and bundles of foil strips.

14. The block-base bag according to claim 1, wherein at least two diffusers are disposed relative to each other in the block-base bag such that at least one of the strips of material and the oblong flow openings are not disposed parallel to each other.

15. The block-base bag according to claim 14, wherein the at least two diffusers are disposed orthogonally relative to each other.

16. The block-base bag according to claim 14, wherein the at least two diffusers are disposed in an arrangement which deviates from the orthogonal one.

17. The block-base bag according to claim 1, wherein the materials of the diffusers are formed from at least one of an air-permeable material and an air-impermeable material.

18. The block-base bag according to claim 17, wherein the air-impermeable material is a foil.

19. The block-base bag according to claim 17, wherein the air-permeable material is formed from at least one of a laminate of the air-permeable material and the air-impermeable material provided with flow openings.

20. The block-base bag according to claim 1, wherein the diffuser is connected to the bag wall via at least one of an adhesive point and a weld point.

21. The block-base bag according to claim 1, wherein the block-base bag is formed by two webs made of the filter material which are welded together in the edge region.

22. The block-base bag according to claim 20, wherein the diffuser is connected to the edge region of the block-base bag.

23. The block-base bag according to claim 1, wherein the block-base in the operating state represents the basic surface of the block-base bag which forms a prism.

24. The block-base bag according to claim 1, wherein the block-base is disposed at an angle relative to the bag front-side and relative to the bag rear-side, the angle being from 10° to 170°.

25. The block-base bag according to claim 1, wherein the block-base is disposed at an angle relative to the bag front-side and relative to the bag rear-side, the angle being from 45° to 125°.

26. The block-base bag according to claim 1, wherein the block-base bag is deployed by the air itself flowing in through the inlet opening.

27. The block-base bag according to claim 1, wherein the block-base bag in the transporting state is folded such that the block-base is disposed in a planar manner relative to the front- or rear-side of the bag body.

28. The block-base bag according to claim 1, wherein the block-base has at least two foldable side surfaces.

29. The block-base bag according to claim 1, wherein the diffuser is connected to at least one foldable side surface of the block-base bag.

30. The block-base bag according to claim 1, wherein the diffuser is connected to at least one foldable side surface of the block-base bag in the region of the fold.

* * * * *